US011738968B2

(12) United States Patent
Mustonen et al.

(10) Patent No.: US 11,738,968 B2
(45) Date of Patent: *Aug. 29, 2023

(54) AUTOMATIC FAULT CLEARING FOR ELEVATORS, ESCALATORS AND AUTOMATIC DOORS

(71) Applicant: Kone Corporation, Helsinki (FI)

(72) Inventors: Matti Mustonen, Helsinki (FI); Shaun Sequeira, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 17/499,092

(22) Filed: Oct. 12, 2021

(65) Prior Publication Data

US 2022/0041405 A1 Feb. 10, 2022

Related U.S. Application Data

(63) Continuation of application No. 15/986,092, filed on May 22, 2018, now Pat. No. 11,180,343.

(30) Foreign Application Priority Data

Jun. 14, 2017 (EP) ..... 17176020

(51) Int. Cl.

| | |
|---|---|
| ***B66B 1/34*** | (2006.01) |
| ***B66B 25/00*** | (2006.01) |
| ***B66B 5/00*** | (2006.01) |

(52) U.S. Cl.

CPC ..... *B66B 1/3453* (2013.01); *B66B 1/3407* (2013.01); *B66B 1/3461* (2013.01); (Continued)

(58) Field of Classification Search

CPC ..... B66B 5/0031; B66B 5/02; B66B 5/0018; B66B 5/0037; B66B 5/00; B66B 5/0087; (Continued)

(56) References Cited

U.S. PATENT DOCUMENTS 4,263,987 A 4/1981 Satoh et al.
4,771,865 A 9/1988 Hinderling
(Continued)

FOREIGN PATENT DOCUMENTS

CN 1205674 A * 1/1999 ..... B66B 5/0006
CN 105060055 A * 11/2015 ..... B66B 5/02
(Continued)

OTHER PUBLICATIONS

Office Action dated Feb. 4, 2021, corresponding to U.S. Appl. No. 15/986,092.
(Continued)

*Primary Examiner* — Marlon T Fletcher
(74) *Attorney, Agent, or Firm* — Harness, Dickey & Pierce, P.L.C.

(57) ABSTRACT

A device and a method for controlling an apparatus being an elevator, an escalator or automatic doors are provided, by which it is detected whether a fault is present in the apparatus, it is determined, when the fault is present, whether an automatic fault clearing may be carried out, and if it is determined that the automatic fault clearing may be carried out, the automatic fault clearing is performed by automatically clearing one or more faults.

20 Claims, 4 Drawing Sheets

(52) U.S. Cl.
CPC ..... *B66B 5/0025* (2013.01); *B66B 5/0031* (2013.01); *B66B 5/0087* (2013.01); *B66B 25/00* (2013.01); *B66B 25/006* (2013.01); *B66B 1/3492* (2013.01)

(58) Field of Classification Search
CPC ..... B66B 1/30; B66B 1/3461; B66B 5/0006; B66B 3/00; B66B 13/22; B66B 5/021; B66B 3/002; B66B 5/0093; B66B 25/00; B66B 29/00; B66B 25/006; B66B 1/3415; B66B 19/007; B66B 11/04; B66B 27/00; B66B 13/26; B66B 5/028; B66B 1/343; B66B 13/125; B66B 13/00; B66B 7/1207; B66B 1/34
See application file for complete search history.

(56) References Cited

U.S. PATENT DOCUMENTS

| | | | | |
|---|---|---|---|---|
| 4,898,263 | A | 2/1990 | Manske et al. | |
| 5,445,245 | A | 8/1995 | Ketoviita | |
| 5,526,256 | A | 6/1996 | Sakata et al. | |
| 5,760,350 | A | 6/1998 | Pepin et al. | |
| 5,765,664 | A * | 6/1998 | Herkel | B66B 5/0018 187/277 |
| 7,172,055 | B2 | 2/2007 | Engel et al. | |
| 7,350,626 | B2 | 4/2008 | Lence et al. | |
| 11,180,343 | B2 * | 11/2021 | Mustonen | B66B 5/0031 |
| 2007/0261924 | A1 | 11/2007 | Lindberg et al. | |
| 2008/0278281 | A1 | 11/2008 | Lavin et al. | |
| 2009/0133965 | A1 * | 5/2009 | Mattila | B66B 5/048 187/288 |
| 2012/0043180 | A1 | 2/2012 | Braasch et al. | |
| 2018/0346287 | A1 | 12/2018 | Fragner | |
| 2018/0362292 | A1 * | 12/2018 | Mustonen | B66B 1/3407 |
| 2018/0362293 | A1 * | 12/2018 | Mustonen | B66B 5/027 |
| 2020/0031618 | A1 | 1/2020 | Siugaraju et al. | |
| 2020/0172374 | A1 | 6/2020 | Hall et al. | |
| 2020/0270096 | A1 | 8/2020 | Hall et al. | |
| 2020/0307955 | A1 | 10/2020 | Ye et al. | |
| 2021/0078822 | A1 | 3/2021 | Nash et al. | |

FOREIGN PATENT DOCUMENTS

| | | | | | |
|---|---|---|---|---|---|
| CN | 110088024 | A | * | 8/2019 | B66B 1/34 |
| CN | 110099861 | A | * | 8/2019 | B66B 3/00 |
| CN | 110088025 | B | * | 11/2020 | B66B 1/3423 |
| EP | 3415453 | A1 | * | 12/2018 | B66B 1/3407 |
| EP | 3415454 | A1 | * | 12/2018 | B66B 1/3407 |
| JP | 6522254 | B2 | * | 5/2019 | B66B 5/00 |
| KR | 100218403 | B1 | * | 8/1997 | |
| WO | WO-2007086872 | A1 | * | 8/2007 | B66B 1/3492 |

OTHER PUBLICATIONS

Notice of Allowance dated Jul. 14, 2021, corresponding to U.S. Appl. No. 15/986,092.
European Search Report for Application No. EP 17 17 6020 dated Dec. 15, 2017.

* cited by examiner

AUTOMATIC FAULT CLEARING FOR ELEVATORS, ESCALATORS AND AUTOMATIC DOORS

This application is a continuation of U.S. application Ser. No. 15/986,092, filed on May 22, 2018, which claims priority to, European Patent Application No. EP171760200 filed on Jun. 14, 2017, the entire contents of which are incorporated herein by reference.

FIELD OF THE INVENTION

The present invention relates to an apparatus, a method and a computer program product for performing an automatic fault clearing operation in an elevator in case a fault is present.

RELATED BACKGROUND ART

The following description of background art and examples may include insights, discoveries, understandings or disclosures, or associations, together with disclosures not known to the relevant prior art, to at least some examples of embodiments of the present invention but provided by the invention. Some of such contributions of the invention may be specifically pointed out below, whereas other of such contributions of the invention will be apparent from the related context.

Some examples of the present disclosure relate to elevators. An elevator can stop due to a fault/malfunction between the floors leaving possible passengers trapped inside the car. Some faults require a power-down sequence and/or RDF (rescue drive function) switch activation i.e. an intervention by a service technician.

In more detail, in some cases when the elevator control software (SW) detects a fault situation, the elevator is stopped immediately. If the car is moving between the floors with passengers inside the car they might get trapped in the elevator as the recovery is possible only when the maintenance technician receives a call-out, enters the site and makes the power cycle to the elevator or activates the service mode to restore normal operation of the device.

For example, when a fault/malfunction occurs in an elevator, this fault can be classified and indicated by a fault code. Based on this fault code, recovery measures can be specified. Thus, for example if such a recovery measure includes operations such as "power down" or "Power Off and On" or "Manual Reset by Machine Room Inspection" or "machine room inspection drive" or "inspection drive", a technician receives the call-out, enters the site and either makes the power cycling (i.e. switches supply power off and on) for the elevator or activates the service mode with a RDF switch in order to release potentially trapped users. If the elevator is still faulted, the needed corrective actions are executed to remove the cause of the fault.

Hence, it is necessary that a technician will enter the site and performs a procedure to fix the fault/malfunction. For example, the technician may perform a power cycling (also referred to as "power off-on") by disconnecting the supply power to the control system manually in order to reboot the system or activating a RDF (rescue drive feature) switch at the machine room or the car roof.

A simplified system state machine is shown in FIG. 4. That is, after performing a "power up sequence" state ST51 successfully ("true"), a normal operation ("idle") state ST52 is entered. If during this state, a fault is detected, a "faulted" state ST53 is entered. The fault may be overcome by activating the RDF switch by a technician, wherein then the system may enter the "idle" state again. Alternatively, the technician may overcome the fault by performing power cycling. In this case, the system will enter the power up sequence again, and after successfully carrying the power up, the "idle" state is entered again. Further alternatively, the fault may be overcome by other conditions detected locally, which are handled by the technician manually on site. Also then, the "idle" state may be entered again.

Thus, the above procedure involves costs and also time, during which the passengers are trapped inside the car. Similar disadvantages may also occur in case of escalators or automatic doors.

SUMMARY OF THE INVENTION

Thus, it is an object of the present invention to overcome these disadvantages and to provide a method and a device for controlling an elevator, escalator or automatic doors by which costs and time required for fixing a fault/malfunction of the elevator, escalator or automatic doors can be reduced.

According to a first aspect of the present invention a method for controlling an apparatus being an elevator, an escalator or automatic doors is provided, which comprises:

detecting whether a fault is present in the apparatus, determining, when the fault is present, whether an automatic fault clearing may be carried out, and if it is determined that the automatic fault clearing may be carried out, performing the automatic fault clearing by automatically clearing one or more faults.

According to a second aspect of the present invention a control device for controlling an apparatus being an elevator, an escalator or automatic doors is provided, wherein the control device comprises a controller configured to detect whether a fault is present in the apparatus, determine, when the fault is present, whether an automatic fault clearing may be carried out, and if it is determined that the automatic fault clearing may be carried out, perform the automatic fault clearing by automatically clearing one or more faults.

The first and second aspects may be modified as follows:

Automatically clearing of one or more faults may comprise clearing all faults or clearing faults which prevent returning the apparatus to a predetermined operation mode.

The automatic fault clearing may be performed locally or remotely.

The automatic fault clearing may be performed by activating a rescue drive function (RDF) switch provided at the controller.

If it is determined that the automatic fault clearing may not be carried out, a default error procedure may be performed.

It may be determined whether the automatic fault clearing may be carried out by determining whether the fault in the apparatus fulfills a certain condition.

The condition may specify a kind of a fault of the apparatus in respect to which the automatic fault clearing is allowed.

The number of automatic fault clearings performed for overcoming the fault of the apparatus may be counted, and the condition may specify that the number of automatic fault clearings has not exceeded a predefined threshold.

In case a plurality of default error procedures may be carried out, if it is determined that the automatic fault clearing may not be carried out, a default error procedure of the plurality of default error procedures may be selected based on the condition.

Different priorities may be assigned to different fault conditions, and the default error procedures may be performed based on the priorities.

In case the apparatus is the elevator, a stop at a next floor may be performed in case the automatic fault clearing was successful.

An automatic recovery procedure may be performed directly or indirectly after the automatic fault clearing.

In addition, according to another aspect of the present invention, there is provided a computer program product for a computer, including software code portions for performing the steps of the above defined methods, when said product is run on the computer. The computer program product may include a computer-readable medium on which said software code portions are stored. Furthermore, the computer program product may be directly loadable into the internal memory of the computer or transmittable via a network by means of at least one of upload, download and push procedures.

According to a still further aspect of the present invention a device is provided which comprises means for controlling an apparatus being an elevator, an escalator or automatic doors, means for detecting whether a fault is present in the apparatus, means for determining, when the fault is present, whether an automatic fault clearing may be carried out, and means for performing the automatic fault clearing, if it is determined that the automatic fault clearing may be carried out.

BRIEF DESCRIPTION OF THE DRAWINGS

These and other objects, features, details and advantages will become more fully apparent from the following detailed description of embodiments of the present invention which is to be taken in conjunction with the appended drawings, in which.

DETAILED DESCRIPTION OF EMBODIMENTS

In the following, description will be made to embodiments of the present invention. It is to be understood, however, that the description is given by way of example only, and that the described embodiments are by no means to be understood as limiting the present invention thereto.

It is to be noted that the following examples and embodiments are to be understood only as illustrative examples. Although the specification may refer to "an", "one", or "some" example(s) or embodiment(s) in several locations, this does not necessarily mean that each such reference is related to the same example(s) or embodiment(s), or that the feature only applies to a single example or embodiment. Single features of different embodiments may also be combined to provide other embodiments.

Furthermore, terms like "comprising" and "including" should be understood as not limiting the described embodiments to consist of only those features that have been mentioned; such examples and embodiments may also contain features, structures, units, modules etc. that have not been specifically mentioned.

The general elements and functions of described elevator systems, details of which also depend on the actual type of elevator system, are known to those skilled in the art, so that a detailed description thereof is omitted herein. However, it is to be noted that several additional devices and functions besides those described below in further detail may be employed in an elevator system.

Figure 1:
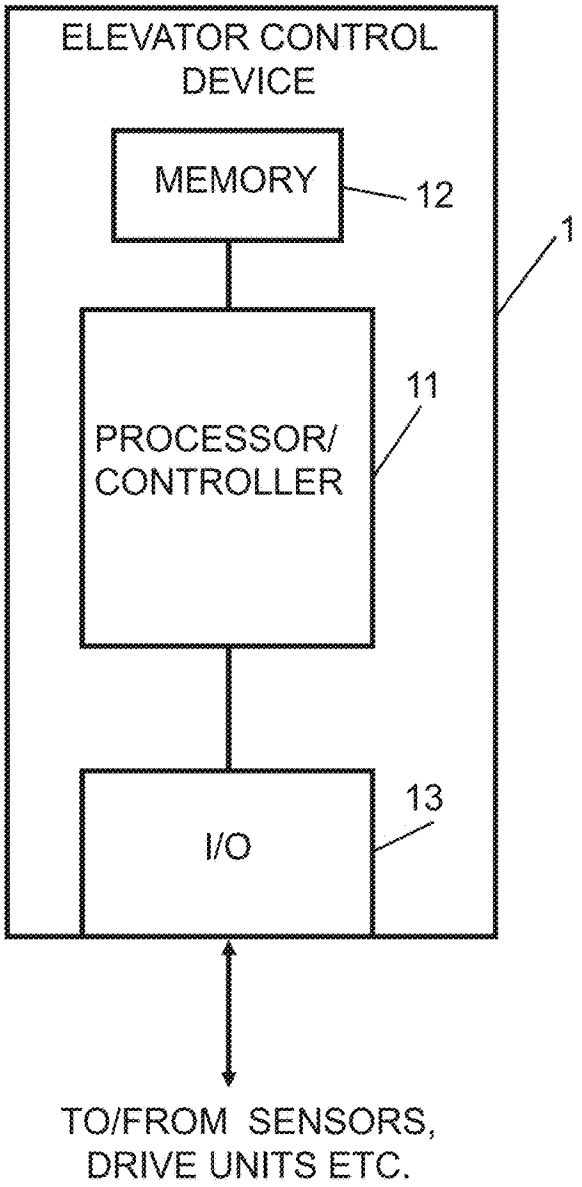
FIG. 1 shows an elevator control apparatus according to some embodiments of the present invention.

FIG. 1 shows a schematic diagram illustrating a configuration of an elevator control device 1 where some examples of embodiments are implementable. In particular, the elevator control device comprises a processor or controller 11. The elevator control device may further comprise a memory 12 in which programs to be carried out and data required are stored, and input/output units 13, via which control signals may be transmitted to other control units, elevator drives etc., and/or signals from sensors or other control units etc. may be received.

Figure 2:
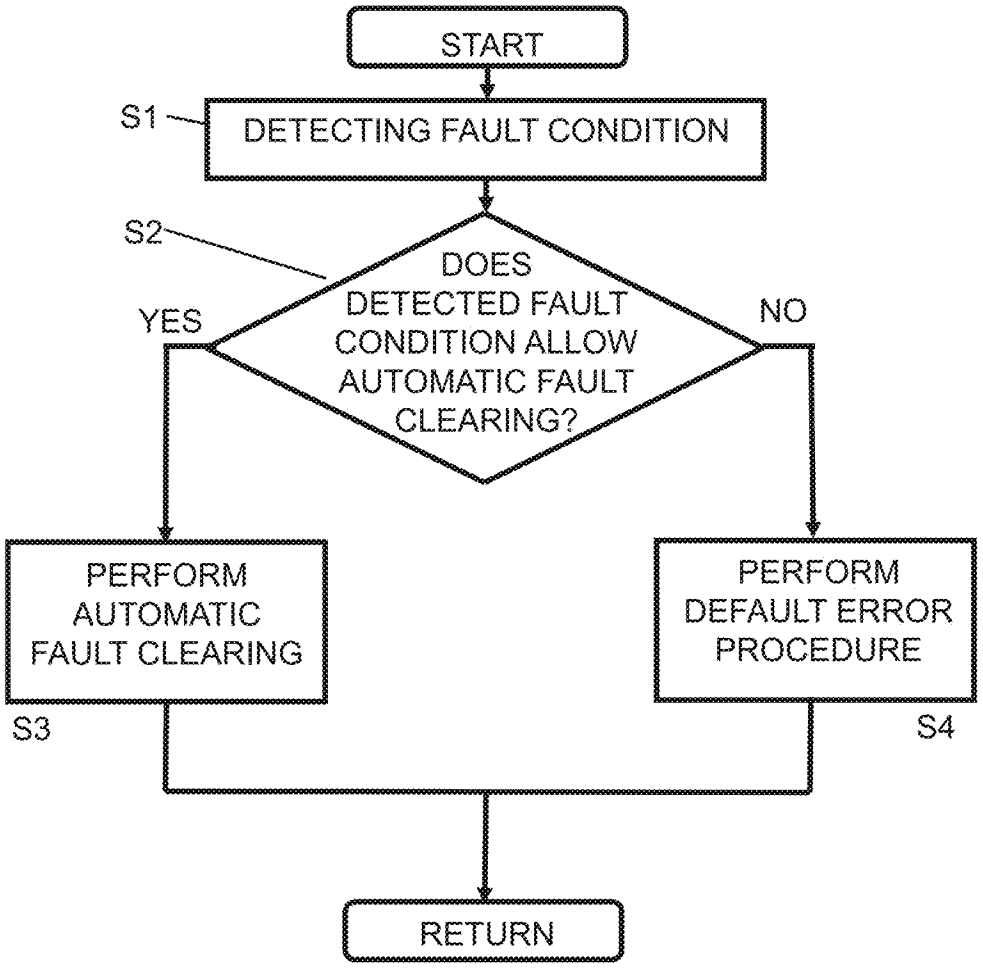
FIG. 2 shows a method for controlling an elevator according to an embodiment of the present invention.

The controller 11 shown in FIG. 1 may be configured to carry out a method as illustrated in FIG. 2.

In particular, the method is carried out when there is a fault situation in the elevator (such as a stop of the elevator car between floors etc.). In step S1, a fault condition, i.e., the condition (state, kind) of the fault is detected. In step S2, it is determined whether the detected fault condition allows an automatic fault clearing. That is, it is determined whether an automatic fault clearing may be carried out. If it is determined that the automatic fault clearing may be carried out (YES in step S2), the automatic fault clearing is performed in step S3, by automatically clearing one or more faults.

If it is determined that the automatic fault clearing may not be carried out (NO in step S2), a default error procedure may be carried out in step S4. Such a default error procedure may taking the elevator out of service, for example. In this case, a technician will have to enter the site and recover the fault manually.

The automatic fault clearing as performed in step S3 may comprise deleting one or more faults stored in a control unit of the elevator. After a successful automatic fault clearing in step S3, a stop at a next floor may be carried out, so that people trapped inside the elevator car may get out.

Furthermore, the automatic fault clearing is performed locally or remotely (e.g., in cloud).

Moreover, the automatic fault clearing may be performed by activating a rescue drive function (RDF) switch provided at the controller. That is, according to some embodiments, clearing of the faults can be effected by a remote activation of an RDF. Activation of the RDF clears all fault signals, i.e. it does a "fault clearing".

Fault clearing means that one or more faults which are stored, e.g., in a fault memory or fault recorder of the controller are cleared. For example, all faults may be cleared.

Moreover, for example at least those faults may be cleared which prevent returning the apparatus to a predetermined operation mode. The predetermined operation mode may be a normal operation mode or a normal service mode. The normal service mode is an operating mode in which the apparatus is, when it is started and reached a full functional state. That is, the normal service mode may be an operation mode in which passengers can be transported (as in case of an elevator or an escalator) or in which automatic doors can be opened and closed automatically. Alternatively stated, the predetermined operation mode may be the operation mode in which the apparatus was when the fault turned the controller into a fault mode.

Examples for a fault that turns the controller to the fault state and that can be tried to solve with fault clearing comprise low voltage or other disturbance in an electric power supplying grid. However, the invention is not limited to these examples, and various other kinds of faults are possible.

Instead of only one default error procedure (such as taking the elevator out of service), a plurality of default error procedures may be carried out when it is determined that the automatic fault clearing may not be carried out. An example for this is given in FIG. 3.

Figure 3:
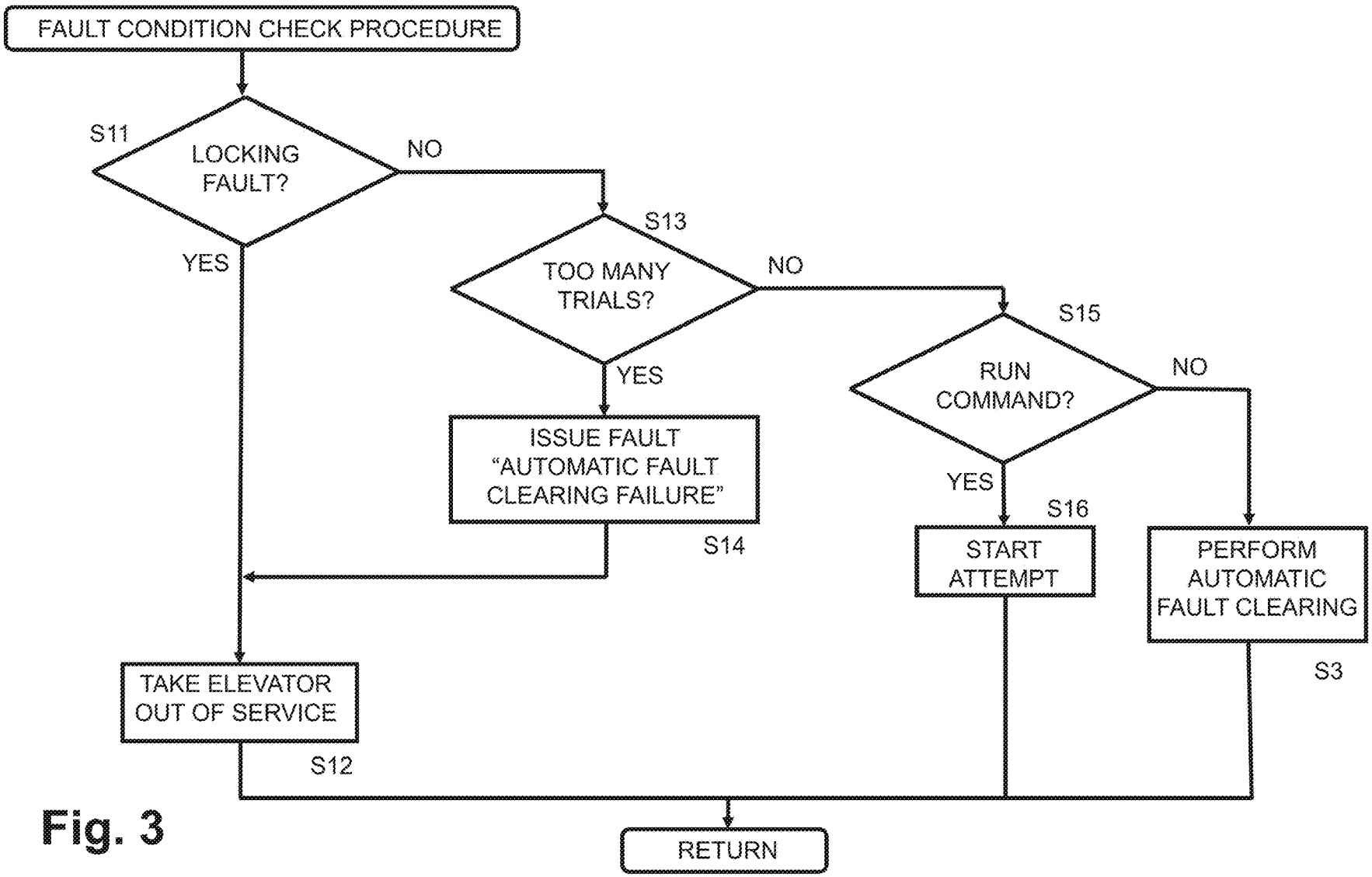
FIG. 3 shows a more detail method for controlling an elevator according to an embodiment of the present invention.
Figure 4:
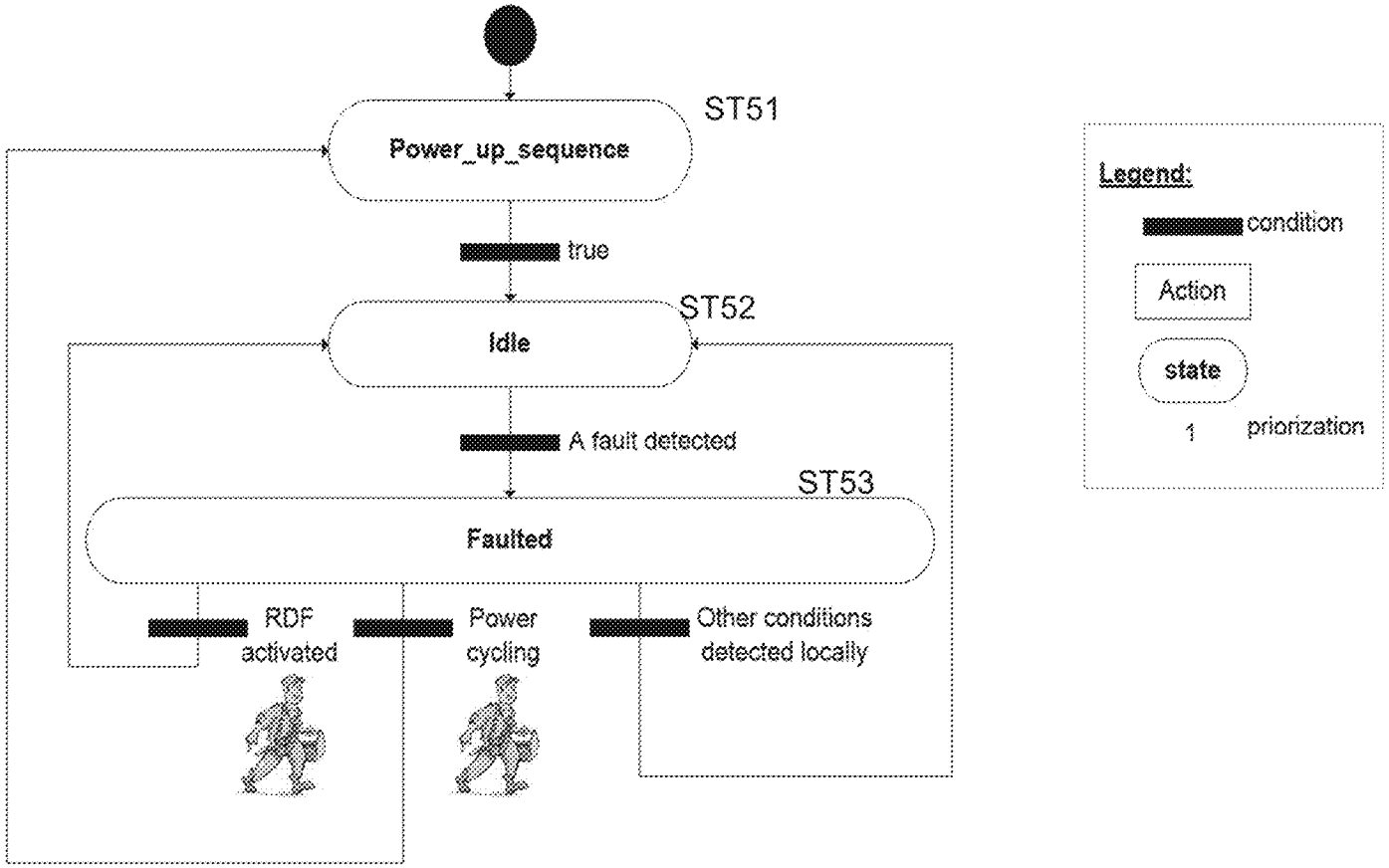
FIG. 4 illustrates a simplified system state machine for fixing a fault/malfunction in an elevator according to the prior art.

FIG. 3 shows such a method, which is basically carried out in place of step S2 of FIG. 2. In step S11, it is checked whether the fault condition indicates a locking fault. A locking fault is a fault which prohibits carrying out an automatic fault clearing. That is, in case the locking fault is detected (YES in step S11), the elevator is immediately taken out of service in step S12.

If no locking fault is detected (NO in step S12), it is checked whether there were already too many trials in step S13. That is, an automatic fault clearing (as shown in step S3) may be attempted a plurality of times. For example, when the automatic fault clearing has been attempted three times without success, it can then be determined that there are too many trials. This can be detected by using a counter, and when the counter exceeds a threshold, it is determined that there are too many trials. If this is the case (YES in step S13), this is indicated in step S14 (by issuing a fault "Automatic fault clearing failure"), and the elevator is taken out of service in step S12.

If there are not too many failures (NO in step S13), it is checked whether there is a Run command present in step S15. Namely, for example a passenger in the elevator may try to start the elevator, thus a run command is issued. If this is the case (YES in step S15), a start is attempted in step S16. It is noted that, even though not shown in FIG. 3, also a number of start attempts may be counted and that in case the number of unsuccessful start attempts exceeds a threshold, this can be regarded as failure.

When there is no run command (or due to start attempt failures the run command will not be carried out, as mentioned above) (NO in step S15), then the automatic fault clearing is carried out in step S3.

Hence, a plurality of conditions may be checked before actually carrying out the automatic fault clearing. In this way, it can be ensured that it is safe to perform the automatic fault clearing.

When a plurality of fault conditions is present, different priorities may be assigned to different fault conditions. For example, the locking fault may have the highest priority.

It is noted that the above embodiment is not limited to consecutively carrying out the determinations such as in the steps S11, S13 and S15. Instead, the priority of the fault condition or a fault code may be detected and based thereon, the corresponding default error procedure may be carried out.

Hence, according to some embodiments, it is utilized that there are many faults from which the elevator is able to recover automatically, either when the fault is no longer active or user makes a car or landing call. Also the RIF board can make some recovery actions.

Thus, according to embodiments of the present invention, it is proposed that an automatic fault clearing be carried out to return the elevator operational unless a specific condition preventing the automatic fault clearing prevails.

Therefore, the risk of passengers becoming trapped in the elevator can be greatly reduced and, also, the number of call-outs for a technician can be reduced. In particular, according to embodiments of the present invention, the elevator can determine whether it can perform the automatic fault clearing and, if not, it can then put itself out of service.

Summarizing, according to the embodiment described above by referring to FIG. 3, when a fault situation is noticed, first the "locking fault" condition is checked and if true, the elevator shall be put to the "Out of service" state (as described above in step S12). The same is done if the automatic fault clearing has been tried too many times (No in step S13).

In the following, some more details regarding handling of a failure of the elevator are described. As described above in connection with step S11 of FIG. 3, firstly, it is checked whether the standards allow automatic fault clearing and thus first a condition "locking fault" needs to be checked. A locking fault is a list of faults (i.e. fault codes) that prohibits an automatic fault clearing for the elevator as it has been clearly stated in the corresponding standards that the recovery must be done by a competent service technician. There shall be dedicated lists for different product implementations (LCE/KCE) and for different regions (e.g., NA/North America, ROW/Rest Of the World) If the fault is in the list, a locking fault is detected and the feature "manual recovery" is entered, actions to activate "Out of service" are executed and the elevator shall remain unavailable with possibly trapped passengers. The recovery to the normal operation shall be done by the service technician who receives the call-out, enters the site and does the normal rescue operations, typically either with the service drive (RDF) and/or the power off-on sequence.

Moreover, some of the faults do not activate a start inhibit and thus it may be allowed to start the elevator when e.g. the passenger makes a car or landing call (as described above in steps S15 and S16 of FIG. 3). If the run command is active, the elevator tries to start a correction drive, preferably to the lighter direction due to battery drive or to the default direction if the lighter direction is unknown. In addition, the locked floors need to be checked also when defining the destination. If the start fails, a re-trial loop is entered until the start succeeds or has been tried too many (e.g. three) times.

The next floor stop operation described above has been implemented as some landing doors were mechanically damaged preventing door opening and thus a new destination with possibility to release trapped passengers from the car was needed. When a destination has been reached, the door opening is tried and if it succeeds (doors open), the feature ends by restoring normal operation. If the doors do not open totally, new destination in the upward direction (or if at the topmost floor, then the lowest floor) that has door(s) and is not locked is set as new destination and the elevator is started. In the unlikely condition all doors failed the control shall post a new fault code "ALL DOORS FAILED TO OPEN" and continues to the manual recovery operation.

The next floor stop operation can be also activated in the normal running mode (i.e. not just with correction drive as would happen after automatic fault clearing) when enabled in the parameter. This is because the feature was seen valuable also without automatic fault clearing and thus needs to be integrated as a part of the normal elevator functionality.

Thus, according to embodiments of the present invention, a long trapment of passengers inside a car and a call-out and technician's site visit can be avoided since the elevator's embedded control software can make the automatic fault clearing without human intervention.

Embodiments of the present invention are not limited to the details of the embodiments as described above, and various modifications are possible.

For example, the elevator control device 1 and in particular the controller 11 shown in FIG. 1 may be provided separately from a control device carrying out the overall control of the elevator, or may be part of a plurality of control units commonly carrying out the control of the elevator. Alternatively, the controller 1 may be part of a main control device carrying out the overall control of the elevator.

Moreover, directly or indirectly after the automatic fault clearing, an automatic recovery procedure may be performed. That is, directly or indirectly after the automatic fault clearing, additionally certain actions may be carried out in order to achieve a fully recovered state of the elevator. For example, these action may comprise rebooting the controller.

Furthermore, in FIG. 3 a detailed functionality of the elevator control was shown. However, embodiments of the present invention are not limited to such details. In particular, the flow can be arbitrarily modified. For example, it is not necessary that before performing the automatic fault clearing, starting of the elevator has to be attempted for a plural times, and the automatic fault clearing may be entered directly, if the fault condition allows such a procedure.

According to some embodiments as described above, a control of an elevator is described. However, embodiments of the present invention are not limited to this. For example, the control may also be applied to an escalator or automatic doors. In this case, also the advantage can be achieved that it is not always required that a technician enters the site. Moreover, the time for taking the escalator or automatic doors into service again can be shortened.

It is to be understood that any of the above modifications can be applied singly or in combination to the respective aspects and/or embodiments to which they refer, unless they are explicitly stated as excluding alternatives.

Furthermore, elevator system elements, in particular operation elements, control elements (e.g., the elevator control device 1) or detection elements, as well as corresponding functions as described herein, and other elements, functions or applications may be implemented by software, e.g. by a computer program product for a computer, and/or by hardware. For executing their respective functions, correspondingly used devices, elements or functions may include several means, modules, units, components, etc. (not shown) which are required for control, processing and/or communication/signaling functionality. Such means, modules, units and components may include, for example, one or more processors or processor units including one or more processing portions for executing instructions and/or programs and/or for processing data, storage or memory units or means for storing instructions, programs and/or data, for serving as a work area of the processor or processing portion and the like (e.g. ROM, RAM, EEPROM, and the like), input or interface means for inputting data and instructions by software (e.g. floppy disc, CD-ROM, EEPROM, and the like), a user interface for providing monitor and manipulation possibilities to a user (e.g. a screen, a keyboard and the like), other interface or means for establishing links and/or connections under the control of the processor unit or portion (e.g. wired and wireless interface means etc.) and the like. It is to be noted that in the present specification processing portions should not be only considered to represent physical portions of one or more processors, but may also be considered as a logical division of the referred processing tasks performed by one or more processors.

For the purpose of the present invention as described herein above, it should be noted that

- embodiments suitable to be implemented as software code or portions of it and being run using a processor or processing function are software code independent and can be specified using any known or future developed programming language, such as a high-level programming language, such as objective-C, C, C++, C #, Java, Python, Javascript, other scripting languages etc., or a low-level programming language, such as a machine language, or an assembler.
- implementation of embodiments is hardware independent and may be implemented using any known or future developed hardware technology or any hybrids of these, such as a microprocessor or CPU (Central Processing Unit), MOS (Metal Oxide Semiconductor), CMOS (Complementary MOS), BiMOS (Bipolar MOS), BiCMOS (Bipolar CMOS), ECL (Emitter Coupled Logic), and/or TTL (Transistor-Transistor Logic).
- embodiments may be implemented as individual devices, apparatuses, units, means or functions, or in a distributed fashion, for example, one or more processors or processing functions may be used or shared in the processing, or one or more processing sections or processing portions may be used and shared in the processing, wherein one physical processor or more than one physical processor may be used for implementing one or more processing portions dedicated to specific processing as described,
- a device may be implemented by a semiconductor chip, a chipset, or a (hardware) module including such chip or chipset;
- embodiments may also be implemented as any combination of hardware and software, such as ASIC (Application Specific IC (Integrated Circuit)) components, FPGA (Field-programmable Gate Arrays) or CPLD (Complex Programmable Logic Device) components or DSP (Digital Signal Processor) components.
- embodiments may also be implemented as computer program products, including a computer usable medium having a computer readable program code embodied therein, the computer readable program code adapted to execute a process as described in embodiments, wherein the computer usable medium may be a non-transitory medium.

Although the present invention has been described herein before with reference to particular embodiments thereof, the present invention is not limited thereto and various modifications can be made thereto.

The invention claimed is:

1. A method for controlling an apparatus, the apparatus being an elevator, an escalator or an automatic door, the method comprising:

- detecting whether a fault is present in the apparatus;
- determining whether to perform an automatic fault clearing in response to detecting the fault is present; and
- performing the automatic fault clearing in response to determining to perform the automatic fault clearing, the automatic fault clearing including clearing a fault, wherein the determining whether to perform the automatic fault clearing determines to perform the automatic fault clearing in response to detecting a run command is not present in the apparatus.

2. The method according to claim 1, wherein the automatic fault clearing comprises:

clearing all faults; or clearing one or more faults which prevent an operation mode of the apparatus.

3. The method according to claim 1, wherein the automatic fault clearing is performed locally by a controller of the apparatus.

4. The method according to claim 1, wherein the automatic fault clearing is performed by activating a rescue drive function (RDF) switch provided at a controller of the apparatus.

5. The method according to claim 1, further comprising:

performing a default error procedure in response to determining not to perform the automatic fault clearing.

6. The method according to claim 1, wherein the determining whether to perform the automatic fault clearing determines whether to perform the automatic fault clearing based on whether the fault fulfills a condition.

7. The method according to claim 6, wherein the condition specifies that the fault be of a fault type.

8. The method according to claim 6, wherein the method further comprises:

counting a number of previous automatic fault clearing attempts for overcoming the fault, wherein the condition specifies that the number of previous automatic fault clearing attempts not exceed a threshold.

9. The method according to claim 5, further comprising:

selecting the default error procedure from among a plurality of default error procedures based on a condition, the determining whether to perform the automatic fault clearing being based on the condition.

10. The method according to claim 9, wherein different priorities are assigned to different faults; and the performing the default error procedure performs the default error procedure based on the priorities.

11. The method according to claim 1, wherein the apparatus is the elevator; and the method further comprises performing a stop at a next floor in response to the performing the automatic fault clearing being successful.

12. The method according to claim 1, further comprising:

performing an automatic recovery procedure after the automatic fault clearing.

13. The method according to claim 10, wherein the fault is one of a plurality of faults present in the apparatus; and the method further comprises assigning the different priorities to the each of the plurality of faults, and performing at least one of the plurality of default error procedures based on the priorities, the plurality of default error procedures corresponding to the plurality of faults.

14. The method according to claim 12, wherein the automatic recovery procedure includes rebooting a controller of the apparatus.

15. A control device for controlling an apparatus, the apparatus being an elevator, an escalator or automatic doors, and the control device comprising:

a controller configured to detect whether a fault is present in the apparatus, determine whether to perform an automatic fault clearing in response to detecting the fault is present, and perform the automatic fault clearing in response to determining to perform the automatic fault clearing, the automatic fault clearing including clearing a fault, wherein the controller is configured to determine to perform the automatic fault clearing in response to detecting a run command is not present in the apparatus.

16. The control device according to claim 15, wherein the controller is configured to determine whether to perform the automatic fault clearing based on whether the fault fulfills a condition.

17. The control device according to claim 16, wherein the condition specifies that the fault be of a fault type.

18. The method according to claim 1, wherein the determining whether to perform the automatic fault clearing determines to perform the automatic fault clearing based on a number of unsuccessful start attempts exceeding a threshold.

19. The method according to claim 1, wherein the automatic fault clearing is performed remote from the apparatus.

20. A non-transitory computer-readable medium storing instructions that, when executed by one or more processors of an apparatus, cause the one or more processors to perform a method, the method comprising:

detecting whether a fault is present in the apparatus;

determining whether to perform an automatic fault clearing in response to detecting the fault is present; and performing the automatic fault clearing in response to determining to perform the automatic fault clearing, the automatic fault clearing including clearing a fault, wherein the determining whether to perform the automatic fault clearing determines to perform the automatic fault clearing in response to detecting a run command is not present in the apparatus.

* * * * *